US005150397A

United States Patent [19]

Randzaao

[11] Patent Number: 5,150,397

[45] Date of Patent: Sep. 22, 1992

[54] THERMAL EMISSIVE COATING FOR X-RAY TARGETS

[75] Inventor: Michael J. Randzaao, New Berlin, Wis.

[73] Assignee: General Electric Company, Milwaukee, Wis.

[21] Appl. No.: 756,417

[22] Filed: Sep. 9, 1991

[51] Int. Cl.[5] ..... H01J 35/10

[52] U.S. Cl. ..... 378/129; 378/127; 378/144; 427/421

[58] Field of Search ..... 378/127-129, 378/143-144; 313/40, 45, 311, 355; 427/421

[56] References Cited

U.S. PATENT DOCUMENTS 4,029,828 6/1977 Bildstein et al. ..... 427/34
4,090,103 5/1978 Machenschalk et al. ..... 313/330
4,132,916 1/1979 Hueschen et al. ..... 313/330
4,516,255 5/1985 Petter et al. ..... 378/144
4,870,672 9/1989 Lindberg ..... 378/129
4,953,190 8/1990 Kukoleck et al. ..... 378/129

*Primary Examiner*—David P. Porta
*Attorney, Agent, or Firm*—Quarles & Brady

[57] ABSTRACT

A high thermal emittance coating for an x-ray tube anode target which permits broad application parameters and a stable and smooth coating. The coating is composed of $ZrO_2$ present in an amount of 8% to 20% by weight and $Al_2O_3$ and $TiO_2$ present in an amount of 92% to 80% by weight with the $Al_2O_3$ and $TiO_2$ being present in a ratio in the range of 4 to 1. A preferable coating is composed of about 10% by weight of $ZrO_2$ and 90% by weight of $Al_2O_3$ and $TiO_2$.

14 Claims, 1 Drawing Sheet

FIG. 1
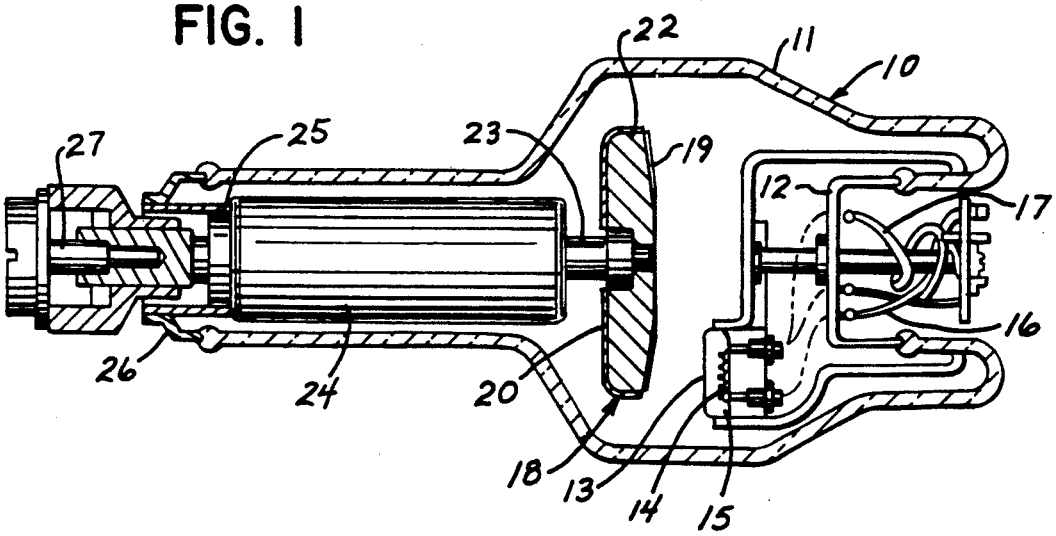
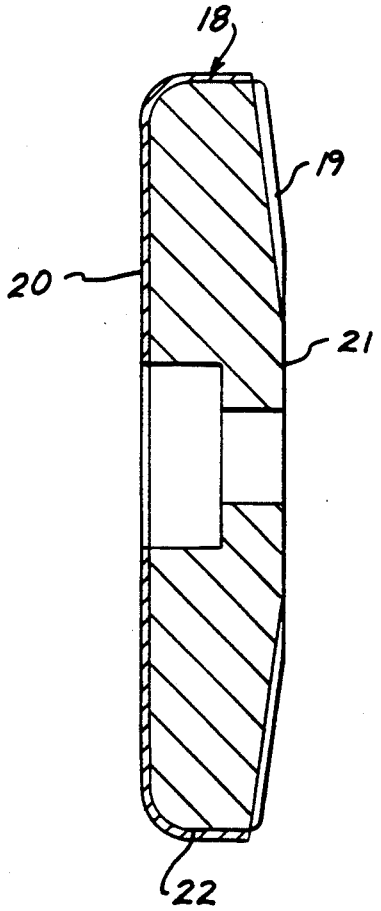
FIG. 2

THERMAL EMISSIVE COATING FOR X-RAY TARGETS

BACKGROUND OF THE INVENTION

This invention relates to an improved coating for thermal emittance of an x-ray tube anode. In particular, the invention discloses a smooth coating which has improved high voltage stability on an x-ray tube anode as well as high thermal emittance.

As stated in U.S. Pat. No. 4,132,916 which is commonly assigned, it is well known that of the total energy involved in an electron beam striking an x-ray target, only 1% of the energy is converted into x-radiation with the remainder of about 99% being converted into heat. As explained in this patent under the "Background of the Invention", it is well known that the thermal emittance of x-ray tube anode targets can be enhanced to some extent by coating the target surface outside of the focal spot track with various coating compounds. The emitted heat is radiated through a glass envelope of the x-ray tube and ultimately to the oil circulating in the tube casing.

A variety of thermal emittance enhancing coatings have previously been used. For example, in the above referred to U.S. Pat. No. 4,132,916 there is described a coating composed of zirconium dioxide ($ZrO_2$), hafnium oxide (HfO), magnesium oxide (MgO), strontium oxide (SrO) cerium dioxide ($CeO_2$) and lanthanum oxide ($La_2O_3$) or mixtures thereof stabilized with calcium oxide (CaO) or yttrium oxide ($Y_2O_3$) and mixed with titanium dioxide ($TiO_2$). This coating provides a "fused" coating on the x-ray anode. While this coating has been commercially acceptable, it has had some problems of low heat transfer, constrained by both low operating temperatures and low thermal emittance. In addition, there have been problems when applying the coating on some alloy substrates, and it has a tendency to "run" onto noncoated areas during the subsequent fusing treatment, thereby requiring further processing steps. More importantly, the process for applying it to the anode requires stringent parameters. One of the more serious problems has been that during vacuum firing of the coating on the anode, the temperature must be kept below 1400° C. This also limits the user's ability to outgas the anodes prior to tube assembly.

In U.S. Pat. No. 4,029,828 there is described an x-ray tube target coating composed of 80–94% alumina ($Al_2O_3$) and 6–20% $TiO_2$. While this particular coating has good heat emissivity, there have been problems with its adhesion.

In U.S. Pat. No. 4,870,672 which is also commonly assigned, there is taught a thermal emittance coating composed of 40% to 70% by weight of $TiO_2$, 20% to 40% by weight $ZrO_2$ and 10% to 20% by weight $Al_2O_3$. This particular coating is being used on a commercial product, but it has produced inconsistant fusing results.

In U.S. Pat. No. No. 4,090,103 there is disclosed a coating layer composed of molybdenum, tungsten, niobium and/or tantalum metals in combination with a 20–60 volume percent of a ceramic oxide such as $TiO_2$, $Al_2O_3$ and/or $ZrO_2$. The in this and the '828 patent provide a "non-fused" coating on the x-ray anode which can present high voltage stability problems under normal operations.

In U.S. Pat. No. No. 4,953,190 which is also commonly assigned, there is described a combined fused and a non-fused anode coating which is composed of $Al_2O_3$ present in an amount of 50% to 80% by weight and $ZrO_2$ or $La_2O_3$ and $TiO_2$ present in an amount of 50% to 20% by weight with the $TiO_2$ and $ZrO_2$ or $La_2O_3$ being present in a ratio in the range of 1:1 to 10:1.

SUMMARY OF THE INVENTION

The invention provides an x-ray tube anode which includes a body having a surface region for being impinged by electrons to produce x-radiation. A coating is placed distinct from the region for enhancing the thermal emittance of the body. The coating is composed of a metal oxide wherein $ZrO_2$ is present in an amount of 8% to 20% by weight of the coating and $Al_2O_3$ together with $TiO_2$ are present in an amount of 92% to 80% by weight of the coating with the $Al_2O_3$ being present with respect to the $TiO_2$ in a ratio of 4 to 1. The coating presents a smooth surface with high voltage stability and has a heat emittance as high as 0.87 at a 2 micrometer wavelength with 1.0 being the theoretical maximum emittance of a black body.

In a preferred manner, the $ZrO_2$ is present in an amount of about 10% and the $Al_2O_3$ and the $TiO_2$ are present in an amount of about 90% of the coating.

A smooth coating material is also presented for an x-ray tube anode which enhances the thermal emittance. The coating is composed of the previously described metal oxides characterized by the $Al_2O_3$ being present with respect to the $TiO_2$ in a ratio of 4:1, respectively.

A method of producing a high thermal emittance coating on an x-ray tube anode is also presented which includes the steps of depositing on selected surface regions of the anode the previously described metal oxide mixture. The anode is heated under vacuum conditions and at a temperature of at least 1500° C. and as high as 1750° C. for a sufficient time to cause the coating mixture to fuse into a smooth black coating with no alumina particles projecting from the coating.

It is an object of the present invention to provide an x-ray tube anode coating material which affords a smooth coating with substantially no removal of particles during the electron beam impingment of the target and is stable at operating temperatures as high as 1500° C.

Another object is a coating material of the foregoing type which has high heat emissivity.

Still another object is to provide a coating composition which exhibits no peeling, flaking, cracking or dusting.

These and other objects and advantages of the invention will be apparent from the following detailed description and drawing.

DESCRIPTION OF THE DRAWINGS

FIG. 1 is a typical rotating anode x-ray tube, shown in section, in which the target coating material of this invention is used; and FIG. 2 is a cross section of the x-ray anode target body shown in FIG. 1.

DESCRIPTION OF A PREFERRED EMBODIMENT

In FIG. 1, the illustrative x-ray tube generally 10 comprises a glass envelope 11 which has a cathode support 12 sealed into one end. A cathode structure 13 comprising an electron emissive filament 14 and a focusing cup 15 is mounted to support 12. There are a pair of conductors 16 for supplying heating current to the filament and another conductor 17 for maintaining the cathode at ground or negative potential relative to the target of the tube.

The anode or target on which the electron beam from cathode 13 impinges to produce x-radiation is generally designated by the reference number 18. Target 18 will usually be made of a refractory metal such as molybdenum or tungsten or alloys thereof but in tubes having the highest rating the target is usually tungsten on a molybdenum alloy substrate. A surface layer on which the electron beam impinges while the target is rotating to produce x-rays is marked 19 and is shown in cross section in FIGS. 1 and 2. Surface layer 19 is commonly composed of tungsten-rhenium alloy for well-known reasons.

The rear surface 20 of target 18 is preferably flat in this example and is one of the surfaces on which the new high thermal emittance coating may be applied. If desired, a concave or convex surface could be employed. The coating may also be applied to areas of the target outside of the focal spot track such as the front surface 21 and the peripheral surface 22 of the target.

In FIG. 1 the target 18 is fixed on a shaft 23 which extends from a rotor 24. The rotor is journaled on an internal hearing support 25 which is, in turn, supported from a ferrule 26 that is sealed into the end of the glass tube envelope 11. The stator coils for driving rotor 24 such as an induction motor are omitted from the drawing. High voltage is supplied to the anode structure and target 18 by a supply line, not shown, coupled with a connector 27.

As is well known, rotary anode x-ray tubes are usually enclosed within a casing, not shown, which has spaced apart walls between which oil is circulated to carry away the heat that is radiated from rotating target 18. The bulk temperature of the target often reaches 1350° C. during tube operation and most of this heat has to be dissipated by radiation through the vacuum within tube envelope 11 to the oil in the tube casing which may be passed through a heat exchanger, not shown. It is common to coat the rotor 24 with a textured material such as titanium dioxide to increase thermal emittance and thereby prevent the bearings which support the rotor from becoming overheated. If the heat storage capacity of the target 18 is not great enough or if its cooling rate is low, duty cycles must be shortened which means that the tube must be kept deenergized until the target reaches a safe temperature. This often extends the time required for an x-ray diagnostic sequence. Hence, it is important that the emittance of the target surfaces be maximized.

The following examples are set forth for the purpose of illustrating the present invention and should not be construed to limit the invention to the precise ingredients, proportions, temperatures or other conditions specified. In the following examples and description, all percent amounts of $Al_2O_3$, $TiO_2$ and $ZrO_2$ are weight percent.

EXAMPLE 1

A coating composed of 72 percent $Al_2O_3$, 18 percent $TiO_2$, and 10 percent $ZrO_2$ (calcia-stabilized, 8%) was applied to 14 molybdenum-based alloy anodes such as 18 on the surfaces 20 opposite the tungsten alloy focal track 19 by plasma spray deposition. The molybdenum-based alloy is in this instance the commonly known TZM material which is a combination of titanium, zirconium and molybdenum. The as-sprayed coating thickness was 2 to 3 mils as measured by an eddy-current device. The coated anodes were fired in a high-vacuum furnace at 1720 degrees C. for 15 minutes, after which the coatings had a matte, black and smooth appearance. There was little evidence of coating migration or "running" to areas beyond those initially coated. Thermal emittance in the 2 micron wavelength range at room temperature was measured to be 0.87.

EXAMPLE 2

A coating composed of 64 percent $Al_2O_6$, 16 percent $TiO_2$, and 20 percent $ZrO_2$ (calcia-stabilized, 8%) was applied to 5 TZM alloy anodes in the manner indicated in Example 1, above. The as-sprayed coating thickness was the same, as measured by an eddy-current device. The coated anodes were fired in a high-vacuum furnace at 1650 degrees C. for 10 minutes, after which the coatings had a matte, grey-black appearance, with little or no running. The emittance value was measured to be approximately 0.84.

EXAMPLE 3

A coating composed of 68 percent $Al_2O_6$, 17 percent $TiO_2$ and 15 percent $ZrO_2$ (calcia-stabilized, 8%) was applied to 5 TZM alloy anodes in the manner indicated in Example 1. The coated anodes were fired in a high-vacuum furnace at 1650° C. for 10 minutes. The coating had good heat emittance at 0.92 but would not fuse completely.

EXAMPLE 4

A coating composition having the same ingredients and amounts as designated in Example 3 was prepared and applied to 5 TZM anodes under the same conditions except the furnace firing was at 1700° C. The coating fused and the heat emittance value was 0.875.

EXAMPLE 5

Additional coating materials were prepared having the following compositions wherein the amounts are in weight %:

| Sample | $Al_2O_3$ | $TiO_2$ | $ZrO_2$ |
|---|---|---|---|
| 1. | 56 | 14 | 30 |
| 2. | 48 | 12 | 40 |
| 3. | 32 | 8 | 60 |
| 4. | 25 | 5 | 70 |

These samples were prepared to determine the effect of increased amounts of $ZrO_2$ while maintaining a 4:1 ratio of $Al_2O_3$ to $TiO_2$ in Samples 1–3 and a 5:1 ratio in Sample 4. They were fired at 1650° C. in the manner indicated in Example 1 onto TZM disks such as indicated at 18. It was found that the samples became progressively more gray as the amounts of $ZrO_2$ increased. This indicates a decrease in thermal emittance. Accordingly these samples would not be as suitable for a commercial product.

EXAMPLE 6

Further samples were tested having the following compositions wherein the amounts are in weight %:

| Sample | $Al_2O_3$ | $TiO_2$ | $ZrO_2.CaO$ |
|---|---|---|---|
| 1. | 60 | 20 | 20 |

-continued

| Sample | $Al_2O_3$ | $TiO_2$ | $ZrO_2.CaO$ |
|---|---|---|---|
| 2. | 55 | 25 | 20 |
| 3. | 50 | 30 | 20 |
| 4. | 45 | 35 | 20 |
| 5. | 40 | 40 | 20 |

These samples were prepared to determine the effect of different ratios of $Al_2O_3$ to $TiO_2$. As in Example 5, the coating compositions were fired under the same conditions at 1650° C. onto TZM disks such as 18. Sample 1 had the best thermal emittance but was not as good as the 0.84 indicated for the 64/16/20 coating of Example 2.

This example illustrates the importance of maintaining the ratio of $Al_2O_3$ to $TiO_2$ in the range of 4 to 1.

It should be pointed out that while certain amounts of $ZrO_2$, $TiO_2$ and $Al_2O_3$ have been illustrated in the Examples to produce successful coatings, successful coatings could also be produced employing $Al_2O_3$, $TiO_2$ and $ZrO_2$ within the following range of amounts:

$ZrO_2$: 8–20%

$Al_2O_3$ and $TiO_2$: 92–80% wherein the $Al_2O_3$ is present with respect to the $TiO_2$ in a ratio in the range of about 4 to 1. Preferably the $ZrO_2$ is present in an amount of 10% to 20% and the $Al_2O_3$ with the $TiO_2$ is present in an amount of 90% to 80%. More preferably the $Al_2O_3$ is present in an amount of 65% to 75%.

As illustrated in the preceding examples, one desirable way of depositing the oxide mixture on the target is to spray it on with a plasma gun. The plasma gun is a well-known device in which an electric arc is formed between a tungsten electrode and a surrounding copper electrode. The oxide materials are conveyed through the arc in a stream of argon gas. While passing through the plasma created by the recombination of the ionized gas atoms, the particles are melted and projected toward the target surface by the gas stream. The molten particles impinge on the surface being coated to effect an initial bond. The as-sprayed coating has a light grey color. Subsequent vacuum firing results in the coating having a matte black color.

The coating may be applied by other methods. The oxides may be entrained in a suitable binder or other volatile fluid vehicle and sprayed or painted on the target surface. The oxides may also be vacuum sputtered in an inert gas or the metals which comprise the oxides may be vacuum sputtered in a partial pressure of oxygen to produce the oxide coatings.

As indicated in the previous examples, the firing temperature should be at least 1650° C. This results in a high temperature stable coating. It should not exceed 1750° C. If the temperature is too high, the fused coating may run or flow to areas not intended to be coated. The oxide composition, after fusing in vacuum, becomes a coating which is stable in the high vacuum of an x-ray tube at least up to 1600° C., which is above any expected temperature for the target outside of the focal track. Coatings formed in accordance with this method, have consistently exhibited thermal emittances of at least 0.84. Most importantly the coatings because of their smooth composition are high voltage stable at 150 kilovolts and under the indicated high temperature conditions at which the target 18 functions under normal operating conditions.

It will be evident to those skilled in the art that the target 18 could not be fired when attached to rotor 24 since the copper and steel portions of the rotor would melt at 1083° C. and 1450° C., respectively.

In the preferred embodiment, the zirconia is stabilized with 8% by weight of calcia. If desired, the amount of calcia could be decreased to 4%. Alternatively, a stabilizer such as yttrium oxide could be employed in the same amounts by weight.

I claim:

1. An x-ray tube anode comprised of a body having a surface region for being impinged by electrons to produce x-radiation and a coating distinct from said region for enhancing the thermal emittance of said body, said coating composed of a metal oxide coating comprising:

$ZrO_2$ present in an amount of about 8% to 20% by weight and $Al_2O_3$ together with $TiO_2$ present in an amount of about 92% to 80% by weight with the $Al_2O_3$ being present with respect to the $TiO_2$ in a ratio in the range of about 4 to 1.

2. The anode as defined in claim 1 wherein said $ZrO_2$ is present in an amount of about 10% to 20% by weight and said $Al_2O_3$ together with $TiO_2$ are present in an amount of about 90% to 80% by weight of said coating.

3. The anode as defined in claim 1 wherein said $Al_2O_3$ is present in an amount in the range of about 65% to 75% by weight of said coating.

4. The anode as defined in claim 1 wherein said $Al_2O_3$ is present in an amount of about 72% by weight, said $TiO_2$ is present in an amount of about 18% by weight and said $ZrO_2$ is present in an amount of about 10% by weight of said coating.

5. The anode as defined in claim 1 wherein said $ZrO_2$ is calcia stabilized.

6. A coating material for an x-ray tube anode comprised of a body having a surface region for being impinged by electrons to produce x-radiation, the coating adapted to be applied distinct from said region for enhancing the thermal emittance of said body comprising:

a coating composed of a metal oxide mixture comprising $ZrO_2$ present in an amount of about 8% to 20% by weight and $Al_2O_3$ together with $TiO_2$ present in an amount of about 92% to 80% by weight with the $Al_2O_3$ being present with respect to the $TiO_2$ in a ratio in the range of at least 4:1.

7. The coating material as defined in claim 6 wherein said $ZrO_2$ is present in an amount of about 10% to 20% by weight and said $Al_2O_3$ together with $TiO_2$ are present in an amount of about 90% to 80% by weight of said coating.

8. The coating material as defined in claim 6 wherein said $Al_2O_3$ is present in an amount in the range of about 65% to 75% by weight of said coating.

9. The coating material as defined in claim 6 wherein said $Al_2O_3$ is present in an amount of about 72% by weight, said $TiO_2$ is present in an amount of about 18% by weight and said $ZrO_2$ is present in an amount of about 10% by weight of said coating.

10. The coating material as defined in claim 6 wherein said $ZrO_2$ is calcia stabilized.

11. The coating material as defined in claim 10 wherein said coating material is fused to said anode body by plasma arc spraying at a temperature of between about 1650° C. and 1750° C.

12. A method of producing a high thermal emittance coating on an x-ray tube anode including the steps of:

depositing on selected surface regions of said anode a particle coating mixture of metal oxides comprising $ZrO_2$ present in an amount of 8% to 20% by weight and $Al_2O_3$ together with $TiO_2$ present in an amount of 92% to 80% by weight with the $Al_2O_3$ being present with respect to the $TiO_2$ in a ratio in the range of about 4:1; and heating said anode under vacuum conditions and at a temperature of at least about 1500° C. for a sufficient time to cause said coating mixture to fuse into a smooth black coating.

13. The method as defined in claim 12 wherein said temperature does not exceed about 1750° C.

14. The method as defined in claim 12 wherein said coating mixture is applied to said anode by plasma spraying.

* * * * *

UNITED STATES PATENT AND TRADEMARK OFFICE

CERTIFICATE OF CORRECTION

PATENT NO. : 5,150,397

DATED : September 22, 1992

INVENTOR(S) : Michael J. Randazzo

It is certified that error appears in the above-identified patent and that said Letters Patent is hereby corrected as shown below:

On title page, item

[75] Inventor: "Randzaao" should be --Randazzo--.

Column 1, line 29 after "(SrO)" a --,-- should be inserted.

Column 1, line 58 after U.S. Pat. No." "No." (second occurence) should be deleted.

Column 1, line 62 before "in" --coatings-- should be inserted.

Column 3, line 7 after "reference" "number" should be --numeral--.

Column 3, line 26 after "internal" "hearing" should be --bearing--.

Column 4, line 12 before ", 16 percent" "6" should be --3--.

Column 4, line 24 before ", 17 percent" "6" should be --3--.

Column 5, line 22 after "$ZrO_2$" the ":" should be deleted.

UNITED STATES PATENT AND TRADEMARK OFFICE

CERTIFICATE OF CORRECTION

PATENT NO. : 5,150,397

DATED : September 22, 1992

INVENTOR(S) : Michael J. Randazzo

It is certified that error appears in the above-indentified patent and that said Letters Patent is hereby corrected as shown below:

Column 5, line 23 after "$TiO_2$" the ":" should be deleted.

Signed and Sealed this

Fifth Day of October, 1993

*Attest:*

*Attesting Officer*

BRUCE LEHMAN

*Commissioner of Patents and Trademarks*